United States Patent [19]

Hargrave, Jr.

[11] Patent Number: 4,549,521

[45] Date of Patent: Oct. 29, 1985

[54] PLASTIC LID FLIPPER

[76] Inventor: Fred M. Hargrave, Jr., 408 Spencer Ave., Marion, Ind. 46952

[21] Appl. No.: 688,898

[22] Filed: Jan. 4, 1985

[51] Int. Cl.[4] ..... A63B 65/00; F41B 3/04; F41J 9/18

[52] U.S. Cl. ..... 124/5; 273/424

[58] Field of Search ..... 124/16, 5, 7, 42; 273/424

[56] References Cited

U.S. PATENT DOCUMENTS

| | | | |
|---|---|---|---|
| 1,607,874 | 11/1926 | Darton | 124/5 |
| 1,807,922 | 10/1929 | La Sala et al. | 124/42 |
| 2,242,122 | 4/1940 | Glover et al. | 273/96 |
| 2,408,984 | 5/1944 | Lawson, Sr. | 124/17 |
| 2,493,245 | 3/1949 | Hansen | 124/5 |
| 2,586,547 | 10/1948 | Marley | 124/5 |
| 3,529,589 | 9/1970 | Esser | 124/5 |
| 3,841,292 | 10/1974 | Hoffman | 124/5 |
| 3,901,208 | 8/1975 | Laporte et al. | 124/5 |
| 4,033,313 | 7/1977 | Ryan | 124/17 |
| 4,076,004 | 2/1978 | Huelskamp | 124/5 |
| 4,277,068 | 7/1981 | Sasaki | 273/324 |
| 4,364,371 | 12/1982 | Woolard | 124/5 |

FOREIGN PATENT DOCUMENTS

| | | | |
|---|---|---|---|
| 2321107 | 3/1977 | France | 124/5 |
| 600301 | 11/1959 | Italy . | |

*Primary Examiner*—Paul E. Shapiro

*Attorney, Agent, or Firm*—Stevens, Davis, Miller & Mosher

[57] ABSTRACT

A toy lid flipper apparatus is disclosed, comprising an elongate spring member having a handle at a first end and a finger for engaging a lid at a second end thereof. The toy lid flipper projects and imparts a spin to a toy lid having a major portion attached to a peripheral rim. A shield is provided to allow the user to flip a lid while, at the same time, protecting the user from injury caused by the relatively sharp end of the engaging finger.

8 Claims, 5 Drawing Figures

PLASTIC LID FLIPPER

BACKGROUND OF THE INVENTION

1. Field of the Invention

This invention relates to a toy, that is a flipper for a plastic disc-like lid. The flipper comprises a length of elongated spring material, having a lid engaging means at a first end thereof, a shield adjacent the engaging means to protect a user from being harmed by the engaging means, and a handle at a second end of the spring member.

2. Description of the Prior Art

Discs which can be thrown, for example the frisbee, are well known in the art. These devices are thrown by hand and require a degree of user skill for accurate throwing. To provide an easier means for projecting a disc, hand-held projecting devices have been developed which require relatively little skill by the user. Examples of disc projecting devices include U.S. Pat. Nos. 1,807,922 to La Sala et al; 2,408,984 to Lawson, Sr.; and 4,033,313 to Ryan, as well as Italian Pat. No. 600,301 to Rocci. These references disclose devices which use an elastomeric material, such as a rubber band, to propel a disc. Elastomeric materials have the disadvantage that the elastomer can break and cause additional expense in replacement costs.

U.S. Pat. No. 2,586,547 to Marley discloses a hand trap device to toss disc-like clay pigeons and it does not employ an elastomeric material. However, this hand trap involves considerable skill by the user to accurately project a clay pigeon.

Elongated spring materials have been employed to project objects, such as spheres, as disclosed in U.S. Pat. Nos. 2,242,122 to Glover et al and 3,841,292 to Hoffman. However, the apparatus disclosed by these references would not be appropriate for projecting a disc, no imparting a spin to a projectile. Spin is important because it allows an object to be projected with greater accuracy and distance. In addition, U.S. Pat. No. 3,841,292 to Hoffman could be hazardous to children. It has a pointed end adjacent to its means for engaging a projectile and this pointed end could injure a child, particularly injure the eyes. Another disadvantage of Hoffman is that it can only project objects which have a borehole. Therefore, a user would have to buy specially bored objects or bore objects themselves. It is likely that some industrious child would be injured by trying to bore his own object for use as a projectile.

U.S. Pat. Nos. 2,493,245 to Hansen and 4,277,068 to Sasaki disclose hand-held projectors which can impart spin to the disc. U.S. Pat. No. 2,493,245 to Hansen discloses a projector comprising a handle attached to a bracket arm attached to a clamping bar which clamps onto a disc. The clamping bar pivots to throw and impart a spinning motion to the disc.

U.S. Pat. No. 4,277,068 to Sasaki discloses a disc projector and catcher which includes a pair of resilient pinching blades, between which a flying disc is loaded. One pinching blade has a slippery edge and the other has an opposing corner. When a thrust is provided by the pinching blades to the disc, the thrust is transformed into a torque between the opposing and slippery corners, thus imparting a spin to the disc. However, both the devices of Hansen and Sasaki have drawbacks. The Hansen device could be dangerous because the clamping bar could injure a child. In addition, the devices of Hansen and Sasaki have mechanical components which could break down.

It would be desirable to have a simple device which can project a disc and impart a spin to the disc. It would also be desirable if such a device would be safe to use.

SUMMARY OF THE INVENTION

According to the present invention, the lid flipper apparatus is a means for imparting a spin to a lid, which includes an elongate spring member having a handle connected to the spring member at a first end thereof, a means for engaging a lid at a second end thereof, a shield for protecting the engaging means connected to the second end thereof, wherein the shield has a flat top portion adjacent and parallel to the spring member and extends from a point between the two ends of the spring member to beyond the means for engaging; wherein the elongate member is flexible along only one axis, and wherein the lid has a planar major portion and a peripheral rim attached to the lid whereby the engaging means contacts the rim.

The lid is preferably made of a flexible soft plastics material and may have a lip along the inside periphery of the rim. The elongate member is preferably a flat rod, and the engaging means is preferably a pointed bent tip portion at the second end thereof.

Accordingly, it is a principal object of the present invention to provide a lid flipper apparatus which is easy to operate, hand-held, can impart a spin to a lid, and provides a shield for projecting the user from a means for engaging the flipper with the lid.

It is another object of the invention to provide a lid flipper apparatus which can be hand-held and impart a spin to a lid, comprising an elongate spring member with a handle at a first end and a tip portion at a second end thereof and a shield to protect a user from the tip portion.

DETAILED DESCRIPTION OF THE INVENTION

Figure 1:
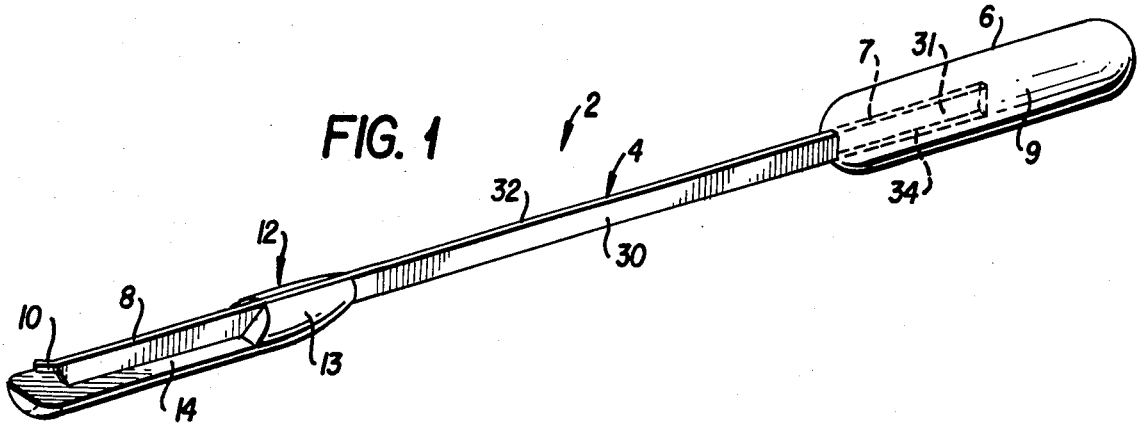
FIG. 1 is a perspective view of a plastic lid flipper.
Figure 2:
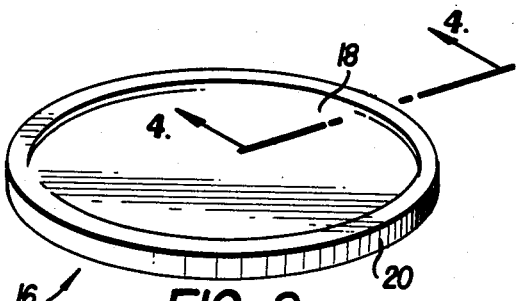
FIG. 2 is a perspective view of a lid.

FIG. 1 shows the preferred embodiment of the lid flipper 2, which comprises an elongate spring member 4 attached to a handle 6 connected to the first end 7 of the spring member 4. A means for engaging 10 a lid 16, as shown in FIG. 2, is provided at a second end 8 of the elongate spring member 4. A shield 12 is provided in order to protect a user from injury by the engaging means 10.

Figure 3:
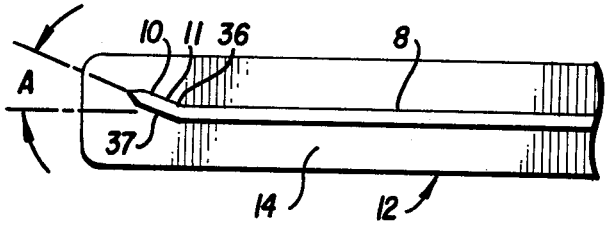
FIG. 3 is a top view of the second end of the spring member showing a means for engaging and a shield.
Figure 5:
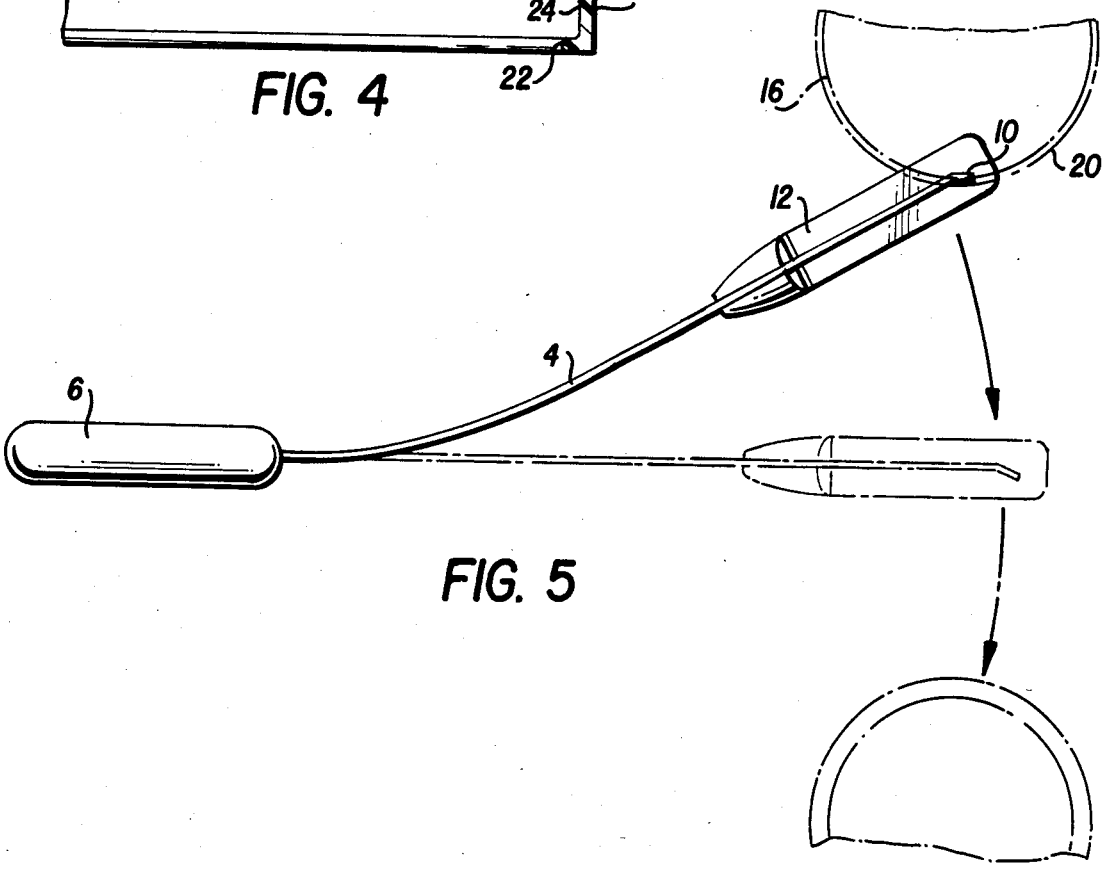
FIG. 5 is a top view showing the plastic lid flipper in use.

The elongate spring member 4 is preferably a flat rod, as shown in FIG. 1, comprising parallel sidewalls 30, 31, a top wall 32 and a bottom wall 34. The spring member 4 is preferably a flat rod, because it is desirable to only allow bending of the elongate spring member 4 in one direction, namely in the plane in which it is desired to flip a lid 16, as described below. Any fluctuations from that plane will reduce shooting accuracy. The engaging means 10 is made by cutting away a lower portion at the tip of the second end 8 of the spring member 4. A remaining portion has a common top wall 32 with the spring member 4 and sidewalls which are common with, and narrower than, the sidewalls 30, 34 of the spring member 4. This tip portion 11 is then bent away from the longitudinal axis of the spring member 4 by an angle A, as shown in FIG. 3. Preferably, angle A is about 45°. The tip portion 11 is bent to the right for a righthanded user, as shown in FIGS. 1, 3 and 5. Preferably, the tip portion 11 has a sharp point to better engage a disc.

The shield 12 allows the engaging means 10 to engage the lid 16. However, it prevents injury to a user caused by contact or scraping against the user's skin. The shield 12 extends from a point between the two ends 7 and 8 of the spring member 4 to a point beyond engaging means 10, thus allowing the engaging of the lid 16, but preventing harm to a user. The shield 12 comprises a flat top portion 14, which is adjacent to a portion of the bottom wall 34 at a second end 8 of the spring member 4, and is parallel to the horizontal longitudinal axis of the spring member 4. Preferably, the shield 12 has a shoulder portion 13, which is attached to the spring member 4 and is flush with the top wall 32 to prevent interfering with flipping a disc, as described below. The advantage of the shield 12 is that by extending it beyond the tip member 11, the shield 12 prevents injury by the relatively sharp tip member 11.

Figure 4:
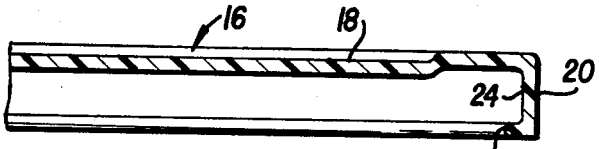
FIG. 4 is a cutaway side view of the lid.

The lid 16 is preferably an ordinary round lid and made of plastic, such as those provided on a variety of products, such as tennis ball cans. The lip flipper 2 can use the lids "as is". Thus, a child does not have to risk injury by using tools or other sharp implements to adapt the lid 16 for use by the lid flipper 2. The lid 16 includes a major planar portion 18 attached to a peripheral rim 20, which provides a surface for the engaging means 10 to contact. As shown in FIG. 4, the peripheral rim 20 may also have an inside lip 22 which is located along the inner periphery of the bottom end of the rim 20. The lip 22 facilitates use of the engaging means 10 by providing a groove 24 for placing the means 10.

FIG. 5 shows how the lid flipper 2 is employed to engage and flip a lid 16. A user holds the handle 6 of the lid flipper 2 with one hand and then places the inside wall of the rim 20 of the lid 16 into contact with the engaging means 10. Then, the lid 16 would be pulled back a desired distance and released, thus projecting the lid 16 in the desired direction. This would also impart a spin to the lid 16, enhancing the accuracy and distance of the projection. For a righthanded user, the best way to hold the flipper 2 is to position the handle 6 back in the middle of the righthand palm and extend the right thumb of the same hand out along the back of the spring member 4.

The invention will be better understood by reference to the following example.

EXAMPLE

In a preferred embodiment of the lid flipper, the spring member 4 is a flat rod of rectangular cross section having a length of about 10 inches, sidewalls 30, 31 of about $\frac{1}{4}$ inch height and top wall 32 and bottom 34 of 1/16 inch width. The spring member 4 is made of a flexible resilient metal. However, any flexible resilient material, such as a plastics material, could be substituted for metal. A handle 6 is attached at a first end 7 of the spring material. The handle has cylindrical sidewalls 9 having a length of about $2\frac{1}{2}$ inches and a diameter of about $\frac{5}{8}$ inch. In this example, the handle 6 is made of plastics material or wood, although other materials could be substituted. The spring member 4 is inserted into a drill hole in the handle 6 and glued to the handle.

The engaging means 10 and shield 12 are located at the second end 8 of the spring member 4. The engaging means 10 is formed by cutting away a bottom portion of the sidewalls 30, 31, thus leaving an exposed tip portion 11. The tip portion 11 shares its top wall with that of the rest of the spring member 4, as shown in FIG. 1. The tip member 11 has sidewalls 36, 37 having a height of about 1/16 inch. The tip 11 is formed to a sharp point to achieve the most positive holding effect and minimize slipping during the "flipping of the lid". Then the tip 11 is bent to an angle A of preferably about 45°.

The shield 12 is preferably a single piece of material, such as plastics or wood, having a length of about 2 inches, having an oval type longitudinal cross-section, and having a width of about $\frac{1}{2}$ inch at its widest point perpendicular to the longitudinal axis. The shield 12 has a shoulder portion 13 having a length of $\frac{7}{8}$ inches. The shoulder portion 13 has a notch drilled through it, and the spring member 4 is located in the notch and secured to the notch by glue. The shield 12 is located so one end is attached about $1\frac{7}{8}$ inches behind the tip 11, and the other end extends about 3/16 inch beyond the tip portion 11, thus preventing injury to a user. The top of the shoulder 13 is flush with the top wall 32 of the spring 4. By making the top of the shoulder 13 flush with the top wall 32, the tip portion 11 can engage the inside of the peripheral rim 20 of the lid 16, while allowing the lid 16 to remain in a more horizontal plane with little angular offset from the spring member 4. This feature also permits a short compact shield 12.

The shield 12 also has a flat wall portion 14 which has a length of about 1 3/16 inch and is adjacent the lower wall 34 of the spring member 4, thus exposing a portion of the second end 8 of the spring member 4.

The flipper may project a wide variety of discs. However, the discs all share some common characteristics. As described above, all the discs 16 must have a peripheral rim 20 for the tip portion 11 to engage. In this example, the disc 16 has a major portion 18 which is circular and has a diameter of about $3\frac{1}{2}$ inches and a peripheral rim 20 with a height of about $\frac{1}{4}$ inch. The major portion 18 is about 1/16 inch thick and the peripheral rim 20 is about 1/16 inch thick. The flat major portion 18 may be absolutely flat, to form only one plane, and circular, or the flat portion 18 may be indented, as shown in FIG. 4. In addition, the disc 16 preferably has an inner lip 22 which forms a groove 24 between it and the top wall 18. The groove 24 is located to provide a place for the engaging means to better engage the lid 16.

The lid 16 is made of plastics material which is soft and light enough not to harm people it may contact in flight. However, the plastic is resilient so it may engage the tip portion 11 and be drawn back to flip the lid 16 without damaging the lid 16.

The lid flipper invention is a great improvement over the prior art, because it allows easy shooting of a lid 16 while, at the same time, protecting a user from injury by providing a shield 12 which protects the user from the relatively sharper tip portion 11. The lid flipper 2 has the advantage of being extremely simple to construct, therefore reducing projection costs, increasing reliability and lengthening useful life. Thus the lid flipper 2 will be extremely appropriate for use by children because it is easy to use and has an extremely rugged design. Also, use of the lid flipper 2 by children is facilitated because the lid flipper 2 can project a wide variety of lids which may be conveniently and safely obtained.

While a specific embodiment of the apparatus aspects of the invention has been shown and described, it should be apparent that many modifications can be made thereto without departing from the spirit and scope of the invention. Accordingly, the invention is not limited by the foregoing description, but is only limited by the scope of the claims appended thereto.

I claim:

1. An apparatus for flipping a lid having a flat major portion and a peripheral rim attached to said major portion, comprising:

an elongate spring member;

a handle connected to said spring member at a first end thereof;

a means for engaging said lid at a second end thereof, whereby said engaging means contacts said rim;

a shield for protecting a user from said engaging means connected to said second end thereof, wherein said protecting shield has a flat top portion adjacent to said spring member and extends from a point between said two ends to beyond said means for engaging;

wherein said elongate member is flexible along said longitudinal axis; and wherein said apparatus is a means for imparting a spin to said lid.

2. The apparatus of claim 1, wherein said spring member is a flat rod of rectangular cross section having two parallel side walls and a top and a bottom wall of smaller dimension than the side walls.

3. The apparatus of claim 2, wherein said engaging means comprises a portion of said spring member bent away from said longitudinal axis and has a common top wall with said spring member and narrower side walls than said spring member.

4. The apparatus of claim 3, wherein said rim has a lip along the inside periphery thereof.

5. An apparatus for flipping a lid comprising an elongate spring member attached to a handle at a first end thereof and being bent at a second end thereof, thereby forming a tip member at said second end and having a shield for protecting a user from said tip member.

6. The apparatus of claim 5, wherein said spring member is a flat rod having two side walls, a top wall attached to said side walls and a bottom wall attached to said side walls, and each of said side walls are larger than each of said top and bottom walls.

7. The apparatus of claim 6, wherein said shield comprises a member having a flat portion which is adjacent said bottom wall and extends beyond said tip member.

8. A toy apparatus for flipping a lid having a flat major portion and a peripheral rim attached to said major portion, comprising:

an elongate flat spring member having a top wall, sidewalls and a bottom wall;

a handle secured to a first end of said spring member;

a means for engaging said lid against a second end of said spring member, thereby permitting engaging and releasing said lip to flip said lid;

a shield for protecting said means for engaging attached to said second end, having a shoulder portion flush with said top wall, comprising a flat portion adjacent and below said engaging means and extending from a point between said two spring ends to beyond said engaging means; and wherein said engaging means comprises a portion of said spring member bent away from the longitudinal axis of said spring member and having a common top wall with said spring member and narrower side walls than said spring member.

* * * * *